US007086645B2

(12) United States Patent
Hardie

(10) Patent No.: US 7,086,645 B2
(45) Date of Patent: Aug. 8, 2006

(54) GAME WITH COLLECTIBLE PIECES

(75) Inventor: Jeannie Burns Hardie, Gardena, CA (US)

(73) Assignee: Mattel, Inc., El Segundo, CA (US)

( * ) Notice: Subject to any disclaimer, the term of this patent is extended or adjusted under 35 U.S.C. 154(b) by 647 days.

(21) Appl. No.: 10/227,064

(22) Filed: Aug. 22, 2002

(65) Prior Publication Data

US 2003/0050119 A1 Mar. 13, 2003

Related U.S. Application Data

(60) Provisional application No. 60/314,266, filed on Aug. 22, 2001.

(51) Int. Cl.
*A63F 9/04* (2006.01)
*A63F 3/00* (2006.01)

(52) U.S. Cl. ..... 273/146; 273/236; 273/288; 273/291

(58) Field of Classification Search ..... 383/74, 383/75, 76, 4, 6, 13, 72; 206/315.1; 273/148, 273/236, 237, 238, 242, 243, 248, 288, 289, 273/290, 291, 293, 296, 271, 138.1, 139, 273/424, 308, 146; 40/27.5
See application file for complete search history.

(56) References Cited

U.S. PATENT DOCUMENTS

| | | | | | |
|---|---|---|---|---|---|
| 672,478 | A | * | 4/1901 | Gedney | 473/592 |
| 1,269,276 | A | | 6/1918 | Harris | |
| 1,467,690 | A | | 9/1923 | Schwarz | |
| 1,935,308 | A | * | 11/1933 | Baltzley | 40/27.5 |
| 2,391,147 | A | * | 12/1945 | Fredriksson | 273/258 |
| 2,479,203 | A | | 8/1949 | Brown | |
| 2,667,353 | A | | 1/1954 | Lanice | |
| 3,091,461 | A | * | 5/1963 | Taylor | 273/341.1 |
| 3,198,523 | A | * | 8/1965 | Stimson | 273/146 |
| 3,473,803 | A | * | 10/1969 | Bodenhamer et al. | 273/459 |
| 3,481,604 | A | * | 12/1969 | Fan | 273/238 |
| 3,968,582 | A | * | 7/1976 | Jones | 40/27.5 |
| 4,227,690 | A | * | 10/1980 | Pitkanen | 273/445 |
| 4,244,584 | A | * | 1/1981 | Viveiros | 273/386 |
| 4,325,556 | A | * | 4/1982 | DeCanto et al. | 273/393 |
| 4,488,727 | A | * | 12/1984 | Lam | 273/236 |
| 4,497,491 | A | * | 2/1985 | Holman | 273/271 |
| 4,546,978 | A | * | 10/1985 | David | 273/146 |
| 4,603,863 | A | * | 8/1986 | Meyer | 273/282.1 |
| 4,743,031 | A | | 5/1988 | Lamie | |
| 4,793,619 | A | * | 12/1988 | Unander-Scharin | 473/569 |
| 4,813,681 | A | | 3/1989 | Volpert, Jr. | |
| 4,874,175 | A | * | 10/1989 | Fischer | 273/146 |

(Continued)

FOREIGN PATENT DOCUMENTS

GB 2 271 724 A * 4/1994

(Continued)

OTHER PUBLICATIONS

Rules for "Talisman the Magical Quest Game", Games Workshop Ltd., © 1983.

(Continued)

*Primary Examiner*—Xuan M. Thai
*Assistant Examiner*—Matthew D. Hoel
(74) *Attorney, Agent, or Firm*—Kolisch Hartwell, et al.

(57) ABSTRACT

The present invention provides a game including a playing surface, collectible playing pieces, marking pieces, and collectible cards. Players take turns trying to create specific hands by throwing the playing pieces. The first player to successfully claim ownership of four consecutive placeholders on the playing surface is the winner.

32 Claims, 2 Drawing Sheets

U.S. PATENT DOCUMENTS

| | | | | | |
|---|---|---|---|---|---|
| 4,936,585 | A | * | 6/1990 | Looney et al. | 273/236 |
| 4,940,242 | A | | 7/1990 | Tingley | |
| 4,969,650 | A | * | 11/1990 | Magara et al. | 273/238 |
| 4,989,874 | A | * | 2/1991 | Freitas | 273/146 |
| 4,991,978 | A | | 2/1991 | Ostrowski | |
| 5,082,286 | A | | 1/1992 | Ryan et al. | |
| 5,166,502 | A | | 11/1992 | Rendleman et al. | |
| 5,188,368 | A | | 2/1993 | Ryan | |
| 5,308,080 | A | | 5/1994 | Lamie | |
| 5,370,460 | A | | 12/1994 | Nelson | |
| 5,419,564 | A | * | 5/1995 | Lamle | 273/264 |
| 5,443,270 | A | | 8/1995 | Loritz | |
| 5,501,468 | A | * | 3/1996 | Browne | 473/588 |
| 5,505,462 | A | * | 4/1996 | Loewen | 273/440 |
| 5,529,395 | A | | 6/1996 | French | |
| 5,651,548 | A | | 7/1997 | French et al. | |
| 5,662,332 | A | | 9/1997 | Garfield | |
| 5,695,191 | A | * | 12/1997 | Frost | 273/260 |
| 5,810,666 | A | * | 9/1998 | Mero et al. | 463/41 |
| 5,833,237 | A | * | 11/1998 | Velich | 273/146 |
| 5,833,240 | A | * | 11/1998 | Barbour | 273/282.1 |
| 5,853,327 | A | | 12/1998 | Gilboa | |
| 5,954,332 | A | | 9/1999 | Mero et al. | |
| 6,007,065 | A | * | 12/1999 | Ress | 273/146 |
| 6,168,158 | B1 | | 1/2001 | Bulsink | |
| 6,190,174 | B1 | * | 2/2001 | Lam | 434/169 |
| 6,269,574 | B1 | * | 8/2001 | Sokolofski | 40/668 |

FOREIGN PATENT DOCUMENTS

| | | | |
|---|---|---|---|
| WO | WO 94/08672 | * | 4/1994 |
| WO | WO00/45910 | | 8/2000 |
| WO | WO 00/45910 | * | 8/2000 |

OTHER PUBLICATIONS

Handbook for "Crazy Bones" Game, Toy Craze, Inc. USA.
Instructions for "Pass the Pigs" Game, David Moffat Enterprises, © 1995.
Various instructional pages from the Internet regarding "POGS" Game.
Rules of Play for "Diskwars" Game, Fantasy Flight Games, © 2000.
Instructions for "Yaztzee" Game, Milton Bradley Company, © 1996.

* cited by examiner

GAME WITH COLLECTIBLE PIECES

CROSS-REFERENCE TO RELATED APPLICATIONS

This application is based upon and claims priority under 35 U.S.C. § 119(e) to the following U.S. provisional patent application, which is incorporated herein by reference in its entirety for all purposes: Ser. No. 60/314,266, entitled "Game With Collectable Pieces," filed Aug. 22, 2001.

BACKGROUND OF THE INVENTION

The present invention relates to roll-playing and fantasy games. The present invention additionally relates to strategy and chance games involving collectible pieces.

SUMMARY OF THE INVENTION

The present invention provides a game including a playing surface, collectible playing pieces, marking pieces, and collectible cards. Players take turns trying to create specific hands by throwing the playing pieces. The first player to successfully claim ownership of a given number of consecutive placeholders on the playing surface is the winner.

The advantages of the present invention will be understood more readily after a consideration of the drawings and the Detailed Description.

DETAILED DESCRIPTION AND BEST MODE OF THE INVENTION

The present invention is a game played by at least two players involving strategy and chance. As will be understood, game 10 may incorporate elements from a particular theme or popular cultural phenomenon, such as a book or movie. In such a case, the elements of game 10 may include depictions, shapes, and colors that reflect or exemplify this theme or phenomenon.

Figure 1:
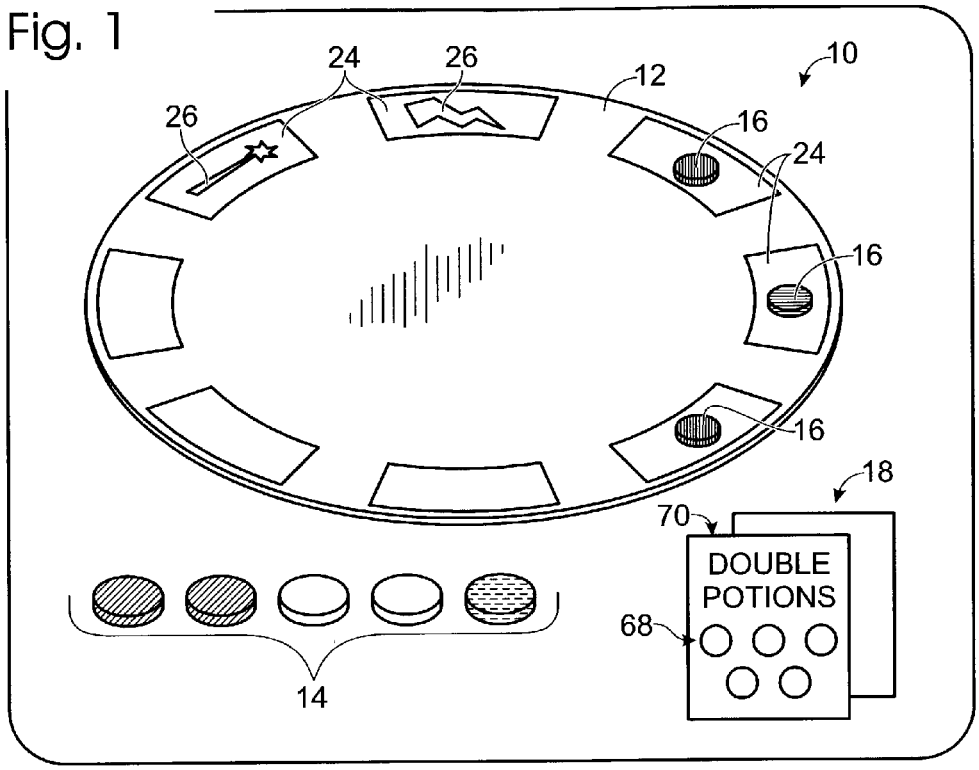
FIG. 1 depicts one embodiment of the game of the present invention, including a playing surface, playing pieces, marking pieces, and cards.

An exemplary embodiment of game 10 is shown in FIG. 1. Typically, game 10 includes a playing surface 12, playing pieces 14, marking pieces 16, and cards 18.

Figure 2:
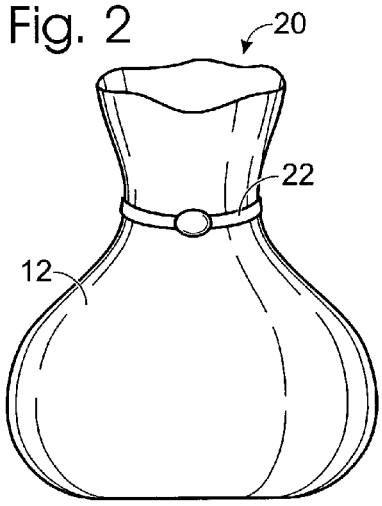
FIG. 2 depicts the playing surface shown in FIG. 1 made into a bag.

As shown in FIG. 2, playing surface 12 may be made of cloth or another type of deformable material that can be folded up to create a bag 20, in which components of the game such as playing pieces 14, marking pieces 16 and cards 18 can be placed, i.e., for storage or transportation. The bag may be secured by any suitable means including an elastic tie 22.

Returning to FIG. 1, the playing surface 12 includes placeholders 24. If desired, these placeholders may be designated with a graphic representation 26 in keeping with the selected theme. For example, in an embodiment of the game that incorporates themes relying on wizards and wizardry, each placeholder may include a depiction of a raised stone decorated with a picture.

In an exemplary embodiment, playing surface 12 may include eight placeholders 24 arranged in a circular pattern around the outer circumference of surface 12. However, as will be appreciated, surface 12 may include more or less than eight placeholders 24, and the placeholders may be arranged in alternative configurations, as desired.

FIGS. 3–7 depict exemplary playing pieces 14. As shown, each playing piece 14 may be generally circular in shape and include a first face 28 (shown in FIG. 3), a second face 30 (shown in FIG. 4) and an annular collar 32, including an outer circumferential edge 34. In the embodiment shown in FIGS. 3 and 4, first face 28 includes a first graphic representation 36 while second face 30 includes a second graphic representation 38.

Typically, the first and second graphic representations are derived from categories that are distinguishable from each other. For example, first graphic representation 36 may be iconic, while second graphic representation 38 may be numeric. Thus, multiple playing pieces 14 may each include an iconic side and a numeric side. As will be appreciated, the iconic sides may depict faces or pictures from the theme on which the game is based, if desired. Moreover, the playing pieces may be provided in a plurality of colors. Thus, each individual playing piece may be distinguished from the others by the combination of its color, first graphic representation, and second graphic representation. Moreover, different pieces may be afforded different value in the game based on the different combinations of color and graphic representations. For example, a playing piece having a numeric side displaying a high numeric value may be more powerful than a playing piece having a low numeric value.

Figure 3:
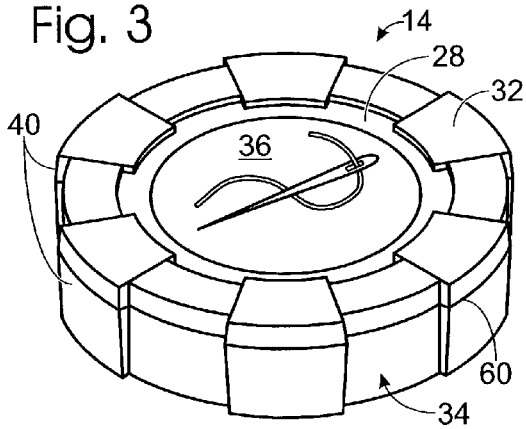
FIG. 3 depicts a first side of a playing piece suitable for use with the game of FIG. 1.
Figure 4:
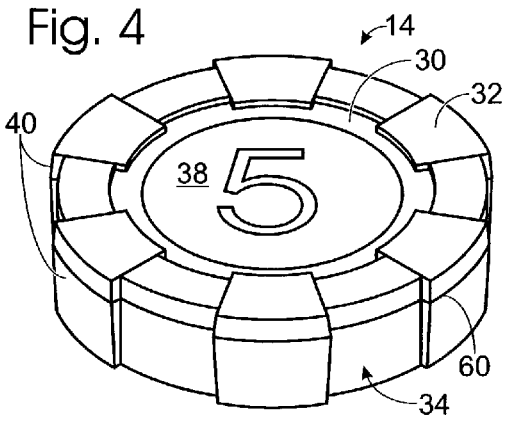
FIG. 4 depicts a second side of the playing piece shown in FIG. 3.
Figure 5:
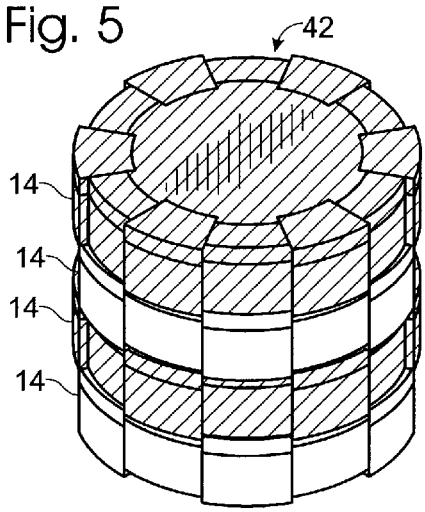
FIG. 5 depicts several playing pieces stacked on top of each other.
Figure 6:
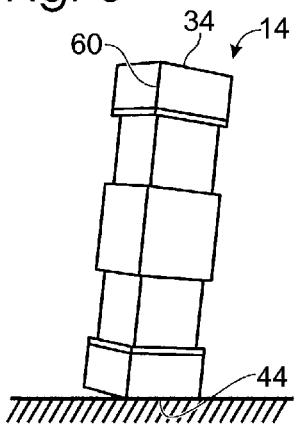
FIG. 6 depicts the playing piece of FIG. 3 standing on its side.

As further shown in FIGS. 3 and 4, annular collar 32 may further include raised portions 40. Each raised portion 40 may extend axially from annular collar 32 to act as an engagement surface on both sides of the playing piece, thus allowing two or more playing pieces to be stacked in an interlocking fashion as shown in FIG. 5 at 42. Furthermore, raised portions 40 may extend radially from annular collar 36 to provide feet 44, such that playing piece 14 may stand stably on edge, as shown in FIG. 6. Moreover, edge 34 may be shaped such that when a playing piece 14 is standing on its edge, the playing piece will preferentially lean slightly to one side, as described in further detail below.

Figure 7:
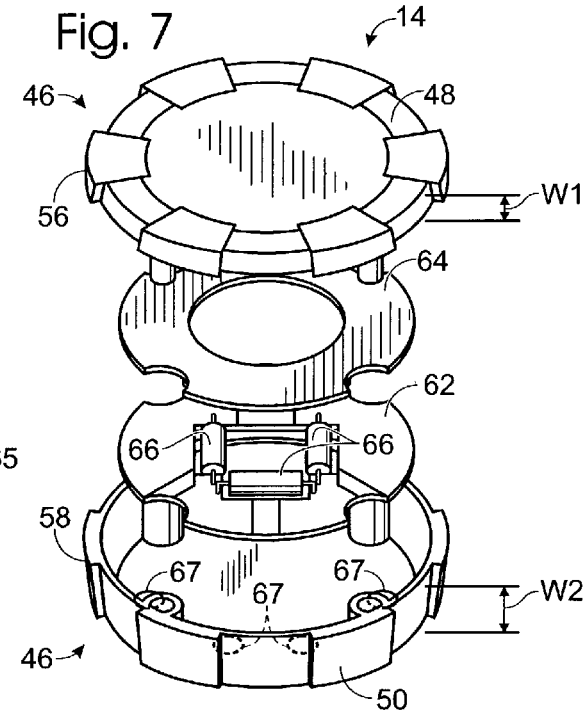
FIG. 7 is an exploded view of the playing piece of FIG. 3 showing a pair of playing pieces shells, a weight, and a circuit board with resistors.

FIG. 7 is an exploded view of the elements that make up each playing piece 14. Each playing piece 14 may be made of an outer casing 46, which may include a first portion 48, corresponding to second face 30, and a second portion 50, corresponding to first face 28. The first and second portions may be joined together with an adhesive or by other suitable means.

As shown, first portion 48 includes an outer wall 56 having a width $w_1$. Likewise, second portion 50 includes an outer wall 58 having a width $w_2$. As can be seen, $w_1$ may be smaller than $w_2$. Moreover, walls 56 and 58 may be slightly outwardly angled to create an apex 60, where the walls meet when first portion 48 is joined to second portion 50. The wider width of outer wall 58 in combination with the outward angle of walls 56 and 58 creates a preferential leaning of playing piece 14 towards second portion 50, when the playing piece is standing on edge, as shown in FIG. 6.

Returning to FIG. 7, each playing piece 14 may house a detectable element 62. Detectable element 62 may provide a detectable signature for each playing piece 14. This detectable signature may be used to allow playing pieces 14 to interact with other games or toys or may be used in the presently described game. Detectable element 62 may include, for example, a metal piece 64 and a series of resistors 66.

Figure 8:
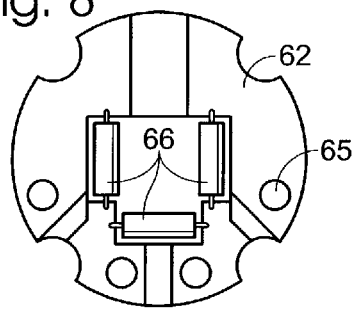
FIG. 8 is a plan view of the reverse side of the circuit board of FIG. 7, showing contact points.

FIG. 8 is a plan view of the circuit board of FIG. 7, showing contact points 65. Contact points 65 may be used when playing piece 14 is used with other separate devices having contact pins configured to touch the contact points 65 of detectable element 62. Contact points 65 may be configured to complete a circuit when contact pins of a separate device (not shown) are inserted through contact pin holes 67 of playing piece 14. Contact pin holes 67 are shown in FIG. 7.

Playing pieces 14 may be made of any suitable material including, for example, plastic. In some embodiments, playing pieces 30 may be manufactured to have a finish and coloration that resembles specific materials including, for example, unpolished stone or granite, glazed terracotta, metal ore or pewter, unfinished wood, and/or marble. As explained above, this finish and coloration may be used to help distinguish different playing pieces from each other.

As stated above with reference to FIG. 1, game 10 may include a plurality of marking pieces 16. Marking pieces 16 generally have at least one flat surface so that marking pieces 16 can be placed on playing surface 12 without rolling. Marking pieces 16 may be made of any suitable material including glass or plastic. Typically the game includes at least two sets of marking pieces 16 with each set being differentiable from the other, for example by color.

As also previously stated, game 10 may further include a plurality of cards 18, shown in FIG. 1. The cards have a front side 68 and a back side 70. Front side 68 generally depicts a specific action that may be taken in the game when a card is in play. Back side 70 generally depicts a generic background that is shared by all cards in the game.

In one method of playing the game, the goal is for one player to place a given number of marking pieces 16 on consecutive placeholders 24. Two or more players may play the game. In a two-player game, each player is given a set of marking pieces 16. In addition, each player creates a casting hand from a pool of playing pieces. The method of allotment may be any suitable method including, the players alternately choosing playing pieces at random from a common pool, each player alternately selecting playing pieces from a common pool, or each player randomly drawing or selecting playing pieces from an individually owned pool. In some methods of play, each player's hand must meet certain requirements. For example, playing pieces may be available in several different colors and each casting hand may be required to have a certain number of each color in his hand. For example, each player's set may be required to have five pieces including two pieces from a first color, for example, brown, two pieces from a second color, for example, white, and one piece from a third color, for example, silver.

In some methods of play, each player has one or more cards 18. Typically, when cards are used, the two players will have the same number of cards.

In one method of play, each player takes his turn throwing, or casting, the playing pieces in his casting hand in a manner similar to rolling dice. Due to their design, each playing piece 14 will land in one of three stable orientations: on first face 28, such that second face 30 is exposed (first face up); on second face 30, such that first face 28 is exposed (second face up), or standing on its edge. In some of the methods of play, if a playing piece 14 lands on its side, the player who cast the piece may chose whether he wants the playing piece to be first face up or second face up. After the initial throw, the player may select between none and all of his playing pieces to throw again. Each player is typically given a predetermined number of throws per turn, for example two.

After the predetermined number of throws, a player will have thrown one of a number of possible hand combinations. These combinations may be based on the various methods of distinguishing the playing pieces from each other. For example, the hand combinations may be based on the color and orientation of the graphic representations on the playing pieces. For example, after two throws, a player may have cast a hand where the two brown playing pieces show iconic faces, the white pieces show numeric faces and the silver piece shows a numeric face. This hand may be distinguished from a hand where the two brown playing pieces are iconic, the two white playing pieces are numeric, and the silver piece is iconic.

Moreover, some of the possible casting combinations may be designated hands, which may allow a player to engage in a particular action, if his designated hand beats his opponent's hand. For example, a combination where all of the playing pieces land iconic face up may be a designated hand that beats a combination where all of the playing pieces land numeric face up. A hand where all of the playing pieces land numeric face up may be a designated hand that beats a hand where all of the playing pieces of a specific color land iconic face up and the other playing pieces land numeric face up. Finally, a hand where all of the playing pieces of a specific color land iconic face up and the other pieces land numeric face up may be a designated hand that beats a hand where all of the playing pieces land iconic up. Thus, each designated hand can beat one designated hand but will lose to another designated hand. A hand that does not satisfy the requirements for any of the designated hands will typically lose to any of the designated hands.

In some cases the players may tie because their hands are identical or because they have both failed to throw a designated hand. In this case, the players may start over with a new throw. When a player wins a hand, that player is typically given some type of reward. The reward may be specific to the designated hand that was thrown by the player. The reward may include the player being able to place one of his marking pieces on one of the placeholders, remove one of his opponent's marking pieces from one of the placeholders, remove one of his opponent's playing pieces from play, thereby forcing him to take an alternative playing piece from the pool of pieces, or remove one of his opponent's cards from play.

In some methods of play, cards 18 are used. The cards may make available additional designated hands and corresponding rewards to the owner of the card. Typically, once a card is used it is unavailable for the remainder of the game. Moreover, players may have a pool of cards available. The pool of cards may be common to all of the players or may be individual to each player.

An exemplary game may have the following format. First and second players alternately select five playing pieces from a common pool of playing pieces. Each player selects two brown, two white, and one silver piece. After two throws, the first player casts a hand showing all iconic faces, this hand is designated in the rules to be a successful potion. After two throws the second player casts a hand showing an iconic face on one brown, one white, and one silver piece and numeric faces on the remaining two pieces. This hand is designated in the rules to be a successful spell. The rules further state that a spell beats a potion and that a player successfully casting a spell may place one marking piece on a placeholder. Having successfully cast a spell, the second player places a marking piece on a placeholder.

In the next turn, the first player casts a hand showing all numeric faces, this hand is designated to be a charm. The second player casts a hand showing numeric faces on four of the pieces and an iconic face on the remaining piece, this is not a designated hand. Because a hand that is not a designated hand loses to all designated hands, the first player has successfully cast a charm. The rules stated that charms allow the casting player to attack the contents of the opponents casting hand. Thus, player one forces player two to remove a particularly valuable piece from his hand and replace it with another piece.

In the next two turns, the first player successfully casts spells and during each turn, the first player places marking pieces on the placeholders on either side of the second player's marking piece. Because the rules require a player to place four marking pieces on adjacent placeholders, the first player has successfully blocked the second player from obtaining four adjacent placeholders using the first marking piece. As previously stated, the rules may allow the second player to remove one of the first player's blocking marking pieces by successfully casting a specific designated hand. Play continues until one player has successfully placed four marking pieces in adjacent placeholders.

In a more advanced version, play is initiated in the same manner but cards 18 are added to game play. The cards may be divvied up in a manner similar to the playing pieces. As previously stated, the cards may indicate designated hands that, when the card is introduced into play, allow the card's owner to engage in specific behavior, which may include: placing marking pieces, removing an opponent's marking pieces; swapping playing pieces or cards with an opponent; forcing an opponent to remove a playing piece or card from the game; or allowing the card's owner to trade a playing piece or card in his hand for one in the pool. As will be appreciated, the cards may be as specific or generic in their requirements as desired. For example, one card may simply require that a player cast two potions in a row, while another card may require that player to cast a charm with specific numbers. Thus, playing pieces that fulfill the requirements of a particularly desirable card may be more highly valued than playing pieces that do not.

Both the playing pieces 14 and the cards 18 may be collectible and may be made available to players through a separate refill or booster pack. Typically a large number of different of playing pieces 30 and cards 80 are available. As many as 100, 200, 500, 1000 or more different playing pieces or cards may be made available. Generally, a certain, large, percentage of the playing pieces or cards will be commonly available and, correspondingly, a certain, small, percentage of the playing pieces or cards will be rare. Typically, the more rare the playing piece or card, the more powerful it is in the game. Playing pieces or cards of intermediate rarity may also be made available.

An example of a set of rules for a game constructed in accordance with an embodiment of the present invention follows:

Objective of the Game

You and your opponent compete with your Casting Stones™, conjuring Spells, Potions and Charms until one of you conquers four adjacent Turrets around the Tower Mat. The first to do so wins the game.

Section A

What are Casting Stones™?

A Casting Stone is a coin-like stone with a number on one side and a symbol on the other. Each symbol represents something magical from the wizarding world. Casting Stones™ Phoenix™ Edition focuses on the terrifying events surrounding the legendary Chamber of Secrets™ and comes in three colors. Each color represents a different category of Stone.

Silver represents a Character

White represents an Artifact

Brown represents an Element

Game Summary

By casting different combinations of symbols and numbers you can create various Spells, Potions and Charms to battle your opponent.

In many ways, the game of Casting Stones is a lot like the old game of "Rock-Scissors-Paper" except that in this case it is "Spells-Potions-Charms."

You and your opponent each start the game with 5 Casting Stones called a Casting Hand, which you'll throw in turn to generate Spells, Potions or Charms. Each throw you make is called a cast. If you fail to cast a Spell, Potion or Charm after your first throw, you can cast any or all of your Stones a second time. You are each allowed two casts per turn. You have cast a Potion if symbols appear on all your Stones. You have cast a Charm if numbers appear on all your Stones. You have cast a Spell if you throw symbols on three different colored Stones (that's 1 Character Stone, 1 Artifact Stone and 1 Element Stone), and numbers on the remaining two Stones (these can be any color).

If, after 2 casts, you have not thrown any of these combinations, you have a Bungle—a failed cast. Once you've both completed your casts, compare them to see who wins that turn: Spell beats Potion, Potion beats Charm, Charm beats Spell.

Depending on the winning cast, the winner of that turn is granted different powers. A winning Spell allows you to place a Turret Gem™ on one of the Turrets on the Tower Mat. A winning Potion allows you to change the Stones in your Casting Hand. A winning Charm allows you to attack the Stones in your opponent's Casting Hand. Remember that Spells are the most important cast because if you succeed in placing four of your Turret Gems on adjacent Turrets, you win the game!

Setting up the Basic Game

1. Open the Tower Mat

Position the Mat so that each of you is seated behind one of the Turrets with the five small Casting Circles in front of it.

2. Divide the Turret Gems™

Each player chooses which color Turret Gems they want to play with and arranges six of that color in a line to their left.

3. Divide the Casting Stones™

Place all the Casting Stones in the center of the Tower Mat, symbol side up. Beginning with the youngest player, take turns selecting one Stone at a time until you each have five Stones in your Casting Hand. You must each choose one silver Character Stone, two white Artifact Stones, and two brown Element Stones.

4. Place the remaining Stones in the Vault

Place the remaining Casting Stones to the side of the Tower Mat in an area that will be called the "Vault." Now you're ready to play!

(CALL-OUT COPY) Player One, Player Two, Turret Gem Line, Vault Area (Basic Play only), Tower Mat, Gryffindor™ Turret, Charms Turret, Ravenclaw™ Turret, Counter-Spell Turret, Slytherin™ Turret, Potions Turret, Hufflepuff™ Turret, Spell Turret, Casting Circles.

Section B

How to Play the Basic Game

The Basic Game of Casting Stones is played in a series of turns made up of six steps. Follow these steps in a practice game before playing for real.

STEP ONE Both players cast their Casting Stones. To start a new game, the youngest player casts first, followed moments later by his or her opponent. To cast, hold your five Casting Stones in both hands about 6 inches above the table. Shake the Stones vigorously at least three times and then drop them all at once in front of you. If the Stones land on top of each other, unstack them, leaving whichever side was on top face-up. Sometimes the Stones land on their side, sticking straight up. This is called a Leaner. Tip the Stone whichever way you want, to finish symbol-side up or number-side up. Once you tip it, you cannot change your mind. Note: You must tip all Leaners before the second cast begins. Depending on how the Stones have fallen, see if you have cast a Potion, a Charm or a Spell:

A player has a Potion if all five Casting Stones land symbol-side up, you have "pictured a Potion". A Potion will beat any Charm your opponent throws. If you both cast a Potion, there is a tie. No one wins that turn and players must cast a new Hand.

A player has a Charm if all five Casting Stones land numbered-side up, you have "calculated a Charm". A Charm will beat any Spell your opponent throws. If you both cast a Charm, add up the numbers on each set of Stones and compare the totals to determine who has the most powerful Charm. If the totals are the same, no one wins that turn and players must cast a new Hand.

A Spell is if you cast symbols on 1 silver Character Stone, 1 white Artifact Stone and 1 brown Element Stone, and numbers on the remaining two Stones, you have cast a Spell. A Spell will beat any Potion your opponent throws. If you both cast a Spell, add the numbers cast for each Spell then compare the totals to decide which Spell is more powerful. If the totals are the same, no one wins that turn and players must cast a new Hand. Note: You can throw a Potion and Charm with any combination of Casting Stones. You do not need to have one of each kind as you do for a Spell.

STEP TWO Both players take their second cast (optional). If you're happy with the combination of symbols and numbers you threw in your first cast, you can stick with it. However, if you didn't throw a Spell, Potion or Charm, you can cast some or all of your Casting Stones again to try to get the combination you want. Whoever cast first in Step One goes first in Step Two. If that player decides to cast again, their opponent waits until they finish. The opponent may then make a second cast if they want one. To make a second cast, choose the Casting Stones from your first cast that you want to keep (if any) and place them on the small Casting Circles on your side of the Tower Mat. Then take your remaining Casting Stones, cast them a second time and place them on the empty Casting Circles. After your second cast if you still haven't thrown a Spell, Potion or Charm, you are left with a Bungle—this is a failed cast.

STEP THREE BUNGLE TRANSFIGURATION (This rule is an expansion of the existing turn sequence introduced in the First Edition of Casting Stones) If both players cast Bungles, they may attempt a Bungle Transfiguration. When both players have Bungles after their second cast, each of them may choose to flip any one of their Stones. With luck, this will transfigure at least one of the casts into a Spell, Potion or Charm. However, if both players still do not have a valid hand, they have failed their casts and must cast new hands.

STEP FOUR Compare the casts and determine who won that turn. Potion (Symbols Only) BEATS Charm (Numbers Only). Charm (Numbers Only) BEATS Spell (3 Symbols+2 Numbers). Spell (3 Symbols+2 Numbers) BEATS Potion (Symbols Only). And any good cast (Spell, Potion or Charm) always beats a Bungle.

STEP FIVE The winner carries out their victory action. Potion beats Charm or Bungle: SWAP! You may choose one of the following options: If you've already placed a Turret Gem on a Turret, swap it with an adjacent Turret Gem belonging to your opponent. OR Swap one of the Casting Stones in your Casting Hand for any Casting Stone in the Vault. Charm beats Spell, Weaker Charm or Bungle: KNOCK-OUT! You may choose one of the following options: Knock one of your opponent's Turret Gems off its Turret on the Mat and back into their Line. OR Knock one of your opponent's Casting Stones into the Vault: choose any Stone from their hand. Your opponent must choose a new Casting Stone from the Vault (and not the one that was just knocked out). Hint: if you knock out your opponent's silver Character Stone, they will be unable to cast any Spells until they recover it. Spell beats Potion, Weaker Spell or Bungle:

PLACE A TURRET GEM™! Place a Turret Gem on an empty Turret of your choice. Remember that you need to get four Turret Gems of your color on adjacent Turrets around the Mat to win the game! Note: You do not have to take your victory action if it does not help you to do so.

STEP SIX: Whoever won the turn casts first on the following turn.

WINNING THE GAME The first player to cover four adjoining Turrets on the Tower Mat with their color Turret Gems is the winner!

SECTION C LIGHTNING STRIKE GAME Lightning Strike is an alternate version of Casting Stones with super-fast game-play for those moments when you don't have a lot of time—between classes, during lunch, whenever you get the itch to cast. Lightning Strike does not require the Tower Mat or Turret Gems. All you need are 5 Casting Stones—but you must have one Stone of each color (at least one Silver, one White and one Brown Stone). You may also use Chasers (see CHASERS below). There are no Swaps, Knock-Outs or Turret Gems to be placed when playing Lightning Strike. This game is nothing more than a race to be the first player to win 4 casts, following the old formula: Spell beats Potion, Potion beats Charm, Charm beats Spell. Keep score in your head, or use markers such as change, pencils or anything else if you want. Just remember—Lightning Strike is all about speed!

SECTION D THE ADVANCED GAME: The Advanced Game comes into play once you expand beyond your Starter Set and collect additional Casting Stones in Booster Packs. Both you and your opponent will need a Starter Set each and at least one Booster Pack each to play the Advanced Game. The Phoenix™ Edition features a total of 125 Casting Stones (see chart for the full list). As you collect, you'll even discover a fourth type of Stone. Called Chasers, these black Stones are especially rare. More about them in a moment.

Each Booster Pack also comes with one of four special charts called Spell Books that help add powerful magic to your hand. SPELL BOOKS: A Spell Book chart is divided into three differently colored sections called chapters. Each chapter contains nine different enchantments that boost the magic of your Casting Hand. Note: Any combination of three different chapters is considered a Spell Book.

(CALL-OUTS) "Spell Book," "The Burrow," "Dobby™," "Quidditch™")

The enchantments in Spell Books are "recipes" for Casting Hands that boost the effect of a Spell, Potion or Charm. By casting the specific combinations of Stones an enchantment requires, you will gain special victory actions. Let's look closer.

(CALL-OUTS) ("Cleansweep Five", "Name", "Magic Type", "Victory Action", "Specific Stones", "Activation Icon", "Interchangeable Stones", "An Enchantment")

Each enchantment in a Spell Book has a name and shows a specific combination of five Casting Stones. In order for the enchantment to work, you must do the following four things: 1. You must indicate that the enchantment is in play by placing a marker on its name—this marker can be a Turret Gem, a penny, or anything else that is convenient. You mark the enchantment at the beginning of the game or by performing a Swap during the game, and may only have three enchantments in play at a time (see below). 2. You must cast the specific Stones listed for that enchantment. Note: Enchantments may call for Stones from previous editions. 3. You must cast the Stones exactly as they appear for that enchantment—number or symbol side up. 4. You must win the turn—Spell beats Potion, Potion beats Charm, Charm beats Spell.

In the bottom right corner of each enchantment is a symbol that denotes the kind of magic it is:

(CALL-OUTS) "Spell", "Charm", "Potion", and "Counter Spell" Although a Counter Spell asks for different combinations of Stones than a regular Spell, it counts as a regular Spell when comparing casts. In the bottom center of the enchantment are symbols telling you the victory action—what you can do if your cast beats your opponent's. Place a Turret Gem . . . , Swap a Casting Stone . . . , Knock-out a Casting Stone . . . , . . . and the number of times it takes effect (+2, +3, etc.). If you throw the exact combination called for and win the hand, you must show your opponent that you matched a marked enchantment in your Spell Book before you can activate its victory action. A Swap, Knock-Out or Turret Gem enchantment must be used immediately; however, you do not have to use the full bonus if it does not help you to do so. Any part of the bonus you do not use is forfeited. Some enchantments come with victory actions you don't need to use right away. The symbols for these actions are colored red. Flip any one of your or your opponent's Casting Stones to the other side . . . Choose any one of your or your opponent's Stones and force them to re-cast it (players re-cast their own Stones) . . . Make any Stone wild for 1 turn (that Stone can represent any color Stone: Silver, White or Brown) . . . Defeat any cast your opponent makes no matter what you cast, then choose your victory action (either a Swap, Knock-Out or Turret Gem) . . . , . . . and the number of times it takes effect (+1, +2, etc.). You do not have to use a Flip, Re-Cast, Defeat Any or a Wild enchantment immediately. If you successfully activate one of these enchantments and wish to save its victory action until later, move your marker onto the small Casting Stone symbol at the bottom left corner of that enchantment. This symbol is called the Activation Icon. You may play an activated enchantment at any point during your or your opponent's turn. You do not have to use all of your victory action if it does not help you to do so, but you forfeit any part of it that you do not use. Note: Although Activation Icons appear on all enchantments, you may only use them to activate Flip, Re-cast, Wild, or Defeat Any enchantments. Once an enchantment victory action has been successfully played, remember to remove the marker from that enchantment and place it in the Vault. You must Swap the marker back into the game to bring another enchantment into play. Note: You may only play one enchantment per turn, and you cannot play the same enchantment twice in one game. Sometimes an enchantment displays Interchangeable Stones inside a box—like the Fred Weasley™ and George Weasley™ Stones on the Cleansweep Five enchantment. You may choose either Stone in such a grouping to make up your Casting Hand. In this case, you could choose either the Fred or George Stone to cast along with your Cleansweep Five, Beater, Harry Potter™, and Bludger Stones. Sometimes you will discover a symbol listed instead of a Casting Stone. These symbols indicate that you can use any Stone of a certain type: (CALL-OUTS) "Any Weasley", "Any Spell", "Any Potion Ingredient", "Any Quidditch™ Player", "Any Quidditch™ Position", "Any Student", "Any Ghost", "Any Wand"

SETTING UP AN ADVANCED GAME: When coming to the table to play the Advanced Game, each player must bring their own set of Casting Stones and one Spell Book to play with. 1. Each player opens their Spell Book in front of them. This area is called their Library. 2. Each places a marker on the name of three enchantments in their Library. You may only have three enchantments in play (marked) at a time. Note: You may only play with one Spell Book—or 3 chapters—at a time and may not keep other Spell Books in your Vault; however, you may store Casting Cards there (see below). 3. Each select 10 Casting Stones from your collections. Choose five for your Casting Hand and place the remaining five in your Vault. Note: You may not play with any duplicate Stones in either your hand or your Vault. That's right, "your" Vault. In the Advanced Game, each player gets their own private Vault. Your opponent cannot take anything you keep there. Set up your Vault on your own side of the Tower Mat, next to your Turret Gems line.

SWAPS AND KNOCK-OUTS When playing the Advanced Game, any in-play enchantment in your Library (those identified by a marker) becomes vulnerable to Swaps and Knock-outs just as Casting Stones are. Charm beats Spell: KNOCK-OUT. Knock one of your opponent's enchantments out of play by knocking a marker from their Spell Book. An enchantment whose marker is knocked from its Activation Icon deactivates; you must Swap the marker back and successfully re-cast the enchantment to activate it again. Potion beats Charm: SWAP Swap one of the markers on an enchantment in your Spell Book to a different enchantment in that Spell Book. Or if an enchantment has been used and its marker placed in the Vault, Swap that marker back from your Vault in order to bring a new enchantment into play. Note: Beginning with the Phoenix Edition, you will discover "Phoenix™ Edition" versions of First Edition Stones. First and Phoenix Edition Stones are inter-changeable. A Harry Potter™ Stone from either the First Edition or the Phoenix Edition will work with any enchantment that requires a Harry Potter Stone.

A NOTE ON CASTING CARDS: If playing with First Edition Casting Cards, you may bring them into play by placing them alongside your Spell Book. Casting Cards do not require markers—if they are outside your Vault they are considered to be in play and vulnerable to Swaps and Knock-outs. You may Swap a Casting Card for a marker or for another Casting Card in your Vault. You may Knock Casting Cards out of play into the Vault as if they were markers. Note: When using Casting Cards with Spell Book enchantments you may have no more than a combined total of three in play at a time. For example: You could have 1 Casting Card and 2 enchantments in play (3 total), but not 2 Casting Cards and 2 enchantments (4 total).

CHASERS: These black Casting Stones are wild in that, when played symbol-side up, they can represent any color Stone, so they can be Character, Artifact or Element Stones as you wish. Because you can use Chasers in so many ways, they are particularly valuable!

SECTION E DUELING CLUB (THREE PLAYER AND FOUR PLAYER GAMES): Objective—When playing Casting Stones with more than two players, the object of the game is to eliminate your opponents by capturing all of their Turret Gems™. The player who captures the most Turret Gems is the winner. Set-Up Each player needs a Casting Hand of 5 Stones, and must have at least one Stone of each color (Chasers may be used). Additionally, players need different colored sets of Turret Gems. Open the Tower Mat in the center of the playing area. Players sit behind the House Turret that corresponds to the color of their Turret Gems (see diagram above for Turret names): Red Gems=Gryffindor™ Blue Gems=Ravenclaw™ Green Gems=Slytherin™ Yellow Gems=Hufflepuff™ Players place four Turret Gems on their Turret (use more for longer games). The Gryffindor player begins.

The Dueling Club Is Called to Order! The first player can challenge any other player at the table. Both players cast as they normally would: Spell beats Potion, Potion beats Charm, Charm beats Spell. There are no Swaps, Knock-Outs, or Turret Gems to be placed. Instead, victory means that you capture one of the Gems on your opponent's Turret. Re-cast any ties. Whoever wins the cast takes a Turret Gem from their opponent's Turret and places it in a pile behind their own Turret. Note: You may only challenge an opponent to capture Gems of their color from their Turret. You cannot capture other-colored Gems that your opponent may have captured from other players. Play proceeds clockwise around the table. When all of the Gems on a player's Turret have been captured, that player is eliminated and must stack their Casting Stones on their Turret to indicate that they are out, but they get to keep any Turret Gems they have captured. When all but one player have been eliminated, players compare the number of Gems they have captured. Any Gems remaining on the last player's Turret may be included in his or her total.

Winning the Game: The player who captures the most Turret Gems is the winner.

SECTION F QUICK-REFERENCE CHART: SEQUENCE OF PLAY: STEP 1 Both players cast their Casting Stones. STEP 2: Both players take their second cast (optional). STEP 3: If both players cast Bungles, they may attempt a Bungle Transfiguration. STEP 4: Compare the casts and determine who won that turn. STEP 5: The winner carries out their victory action. STEP 6: Whoever won the turn casts first on the following turn.

MAGIC TYPE SPELL POTION CHARM

THE CAST, 1 CHARACTER PIX 1 ARTIFACT PIX 1 ELEMENT PIX 2 NUMBERS 5 SYMBOLS 5 NUMBERS VICTORY TYPE: SPELL BEATS POTION, A WEAKER SPELL OR A BUNGLE. POTION BEATS CHARM OR A BUNGLE CHARM BEATS SPELL, A WEAKER CHARM OR A BUNGLE

VICTORY EFFECT: PLACE A TURRET GEM, SWAP, KNOCK-OUT

VICTORY ACTIONS: BASIC GAME (YOU MAY ONLY CHOOSE ONE) Place a Turret Gem on the empty Turret of your choice. Swap one of your Turret Gems™ on the Mat with an adjacent in-play Turret Gem belonging to your opponent. OR Swap a Casting Stone in your Casting Hand with any Casting Stone in the Vault. Knock one of your opponent's Turret Gems™ on the Mat from its Turret back into your opponent's line. OR Knock one of your opponent's Casting Stones from their hand into the Vault. ADDITIONAL VICTORY ACTIONS: ADVANCED GAME Swap one of your in-play enchantment markers to any other enchantment in your Spell Book or for a Casting Card in your Vault. OR Swap a marker into play from your Vault. OR Swap a Casting Card for another Casting Card or marker in your Vault. Knock one of your opponent's enchantment markers or Casting Cards into their Vault.

NEW VICTORY ACTIONS: Flip Re-Cast

Wild Defeat Any

SECTION G: LIST OF CASTING STONES Here is the full list of Phoenix™ Edition Casting Stones™. Use it to keep track of your collection!

1. Fawkes™
2. Basilisk
3. Mandrake
4. Sword of Gryffindor
5. Chamber of Secrets™
6. Whomping Willow™
7. Riddle's Diary
8. Aragog
9. Quidditch™ Cup
10. Fred Weasley™
11. George Weasley™
12. Tom Riddle™
13. Ginny Weasley™
14. Gilderoy Lockhart™
15. Fat Friar
16. Nearly Headless Nick™
17. Dobby™
18. Moaning Myrtle™
19. Sir Patrick Delaney-Podmore
20. Oliver Wood
21. Filch
22. Mrs. Norris
23. Harry Potter™—$2^{nd}$ Year
24. Ron Weasley™—$2^{nd}$ Year
25. Hermione Granger™—$2^{nd}$ Year
26. Draco Malfoy™—$2^{nd}$ Year
27. Dumbledore™—$2^{nd}$ Year
28. Hagrid™—$2^{nd}$ Year
29. Crabbe—$2^{nd}$ Year
30. Goyle—$2^{nd}$ Year
31. Godric Gryffindor
32. Helga Hufflepuff
33. Rowena Ravenclaw
34. Salazar Slytherin
35. Lucius Malfoy
36. Seamus Finnigan
37. Madam Hooch
38. Penelope Clearwater
39. Mr. Borgin
40. Marcus Flint
41. Colin Creevey
42. Justin Finch-Fletchley
43. Millicent Bulstrode
44. Ron's Wand 45. Hermione's Wand
46. Phoenix Tears
47. Hand of Glory
48. Ghoul
49. Errol the Owl
50. Crossbow
51. Earmuffs
52. Pipes
53. Quaffle
54. Bludger
55. Cleansweep Five
56. Chains and Manacles
57. Kwikspell
58. Forbidden Forest
59. Pillowcase
60. Cupboard
61. Draco's Wand
62. Fireplace
63. Moste Potente Potions
64. Filibuster Fireworks
65. Pudding
66. Weasley Car
67. Sock
68. Dumbledore's Spectacles
69. Camera
70. Gilderoy Lockhart's Guide to Household Pests
71. Flying with the Cannons
72. Howler™
73. Garden Gnome
74. Dwarfs (with Wings and Harps)
75. Headless Hunt
76. Heir of Slytherin
77. Sirius Black's Motorcycle
78. Dueling Club
79. Snape's Wand
80. Egg
81. Toad
82. Harry's Scar
83. Phoenix Flames
84. Phoenix Ashes
85. Flesh-Eating Slug Repellent
86. Loyalty
87. Polyjuice Potion™
88. Tarantallegra
89. Skele-Gro
90. Expelliarmus
91. Floo Powder™
92. Snitch Catch
93. Human Fingernails
94. Nimbus Two Thousand™ and One
95. Salamander
96. Boomslang Skin
97. Serpensortia
98. Parseltongue
99. Keeper
100. Courage
101. Detention
102. Freedom
103. Spider Web
104. Seeker
105. Spellotape
106. Beater
107. Deepest Fears & Darkest Secrets
108. Logic
109. Scarlet Light
110. Scream
111. Snake Skin
112. Death
113. Privet Drive
114. Basilisk Gaze
115. Bicorn Horn
116. Black Spiders
117. Finite Incantatem
118. Rictusempra
119. Hogwarts™ Express
120. Rooster
121. Chaser
122. Bloody Playing Cards
123. Glass Eye
124. Rat Intestines
125. Frog Brains

HARRY POTTER
CASTING STONES CHART

| | | |
|---|---|---|
| ***** | CHASER | (A) = ARTIFACTS |
| **** | RARE FOIL | (C) = CHARACTER |
| *** | RARE | (E) = ELEMENTS |
| ** | UNCOMMON | (CH) = CHASER |
| * | COMMON | |

| | |
|---|---|
| DUMBLEDORE | VOLDEMORT |
| Dumbledore (A) | Voldemort (A) |
| ****25 | ****25 |
| Mirror of Erise (C) | Wand (C) |
| ****20 | ****20 |
| Wand (C) | Unicorn Blood (E) |
| ***15 | ***10 |
| Put-Outer (C) | Green Light (E) |
| ***15 | **5 |
| Dragon's Blood (E) | |
| ***10 | |
| Sorting Hat (CH) | |
| *****50 | |
| Music (E) | |
| ***10 | |
| Lemon Drops (C) | |
| **10 | |
| HARRY POTTER | PROFESSOR QUIRRELL |
| Harry Potter (A) | Professor Quirrell (A) |
| ****25 | ****25 |
| Wand (C) | Turban (C) |
| ****20 | ****20 |
| Hedwig (C) | Dragon Egg (C) |
| ***15 | ***15 |
| Flute (C) | Garlic (E) |
| ***15 | ***10 |
| Phoenix Feather (E) | The Dark Forces (C) |
| ***10 | **10 |
| Cloak of Invisibility (CH) | |
| *****50 | |
| DRACO MALFOY | RON WEASLEY |
| Draco Malfoy (A) | Ron Weasley (A) |
| ****25 | ****25 |
| Eagle Owl (C) | Scabbers (C) |
| ***15 | ***15 |
| Goyle (A) | Black Knight (C) |
| **15 | **10 |
| Crabbe (A) | Weasley Sweater (C) |
| **15 | *9 |
| HERMIONE GRANGER | HAGRID |
| Hermione Granger (A) | Hagrid (A) |
| ****25 | ****25 |
| Troll (C) | Pink Umbrella (C) |
| *9 | ***15 |
| Feather (E) | Norbert (C) |
| *4 | ***15 |
| | Fang (C) |
| | ***15 |
| | Violet Light (E) |
| | **5 |
| | Fluffy (CH) |
| | *****50 |

-continued

HARRY POTTER
CASTING STONES CHART

NEVILLE LONGBOTTOM
Neville Longbottom (A)
***20
Remembrall (C)
***15
Trevor (C)
**10

PROFESSOR SNAPE
Professor Snape (A)
****25
Bezoar (C)
**10
Horned Slugs (E)
**5
Root of Asphodel (E)
**5
Infusion of Wormwood (E)
**5
Crushed Snake Fangs (E)
**5
Black Flames (E)
**5
Purple Fire (E)
**5
Cauldron (C)
*6
Magical Drafts and Potions (C)
*8
Potion Bottles (C)
*6
Porcupine Quills (E)
*4
Dried Nettles (E)
*3

PROFESSOR McGONAGALL
Professor McGonagall (A)
****25
White Queen (C)
**10
Snuff Box (C)
**10
Needle (C)
**10
A Beginner Guide to Transfiguration (C)
*8
Mouse (C)
*9
Cat (C)
*9

PROFESSOR BINNS
Professor Binns (A)
****25
A History of Magic (C)
*8

PROFESSOR SPROUT
Professor Sprout (A)
****25
One Thousand Magical Herbs & Fungi (C)
*8
Devil's Snare (C)
*9
Fungi (E)
*1

PROFESSOR FLITWIK
Professor Flitwick (A)
****25
Winged Keys (C)
*9

GHOSTS
Bloody Baron (A)
**15
Peeves (A)
**15

LILY POTTER
Lily Potter (A)
****25
Willow Wand (C)
***15
Love (E)
***10

JAMES POTTER
James Potter (A)
****25
Mahogany Wand (C)
***15

NICOLAS FLAMEL
Nicolas Flamel (A)
****25
Elixir of Life (E)
**5
Gold (E)
*4
Sorcerer's Stone (CH)
*****50

HOUSE SHIELDS WIZARDS
Shield Gryffindor (C)
***15
Shield Slytherin (C)
***15
Shield Hufflepuff (C)
***15
Shield Ravenclaw (C)
***15

CHOCOLATE FROG
Ptolemy (A)
**15
Merlin (A)
**15
Grindelwald (A)
**15
Emeric the Evil (A)
**15
Uric the Oddball (A)
**15

CENTAURS
Firenze (A)
***20
Roman (A)
**15
Bane (A)
**15
Mars (C)
*7
Telescope (C)
*7

SPELLS
Bluebell Flame (E)
**5
Alohomora-Opening (E)
**5
Locomotor Mortis-Leg Locker (E)
**5
Petrificus Totalus (E)
**5
Curse of the Bogies (E)
**5
Wingardium Leviosa (E)
**5

HOGWARDS SUPPLIES
Brass Scales (C)
*6
Crystal Phials (C)
*6
Parchment (C)
*6
Quills (C)
*6
Standard Book of Spells (C)
*8

GRINGOTTS
Griphook (A)
*10
Galleon (C)
*7
Knut (C)
*7
Sickle (C)
*7

BASIC ELEMENTS
Unicorn Hair (E)
**5
Dittany (E)
*1
Bat Spleen (E)
**2
Beetles Eyes (E)
*1
Dragon Liver (E)
*3
Eels Eyes (E)
*2
Fangs (E)
*2
Holly (E)
*3
Mistletoe (E)
*3
Silver (E)
*4
Snarled Claws (E)
*1
Spine of Lionfish (E)
*2

QUIDDITCH
Snitch (C)
*9
Nimbus Two Thousand (CH)
*****50

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements and/or properties may be claimed in this or a related application. Such claims, whether they are directed to a different invention or directed to the same invention, whether different, broader, narrower or equal in scope to any original claims, are also regarded as included within the subject matter of the inventions of the present disclosure.

What is claimed is:

1. A generally disk-shaped playing piece for a game comprising:

a first face displaying a first graphic representation;

a second face displaying a second graphic representation distinguishable from the first graphic representation; and an edge disposed between the first face and the second face and including a first outwardly angled wall and a second outwardly angled wall that form an apex;

wherein the playing piece is adapted to stably land in one of three orientations when tossed onto a surface: on the first face, on the second face, or on a portion of the edge.

2. The playing piece of claim 1 wherein the first graphic representation is iconic.

3. The playing piece of claim 1 wherein the second graphic representation is alphanumeric.

4. The playing piece of claim 1 wherein the edge includes a plurality of radially extending protrusions.

5. The playing piece of claim 1 further including a detectable element adapted to produce a detectable signal.

6. The playing piece of claim 5 wherein the detectable element includes one or more resistors.

7. The playing piece of claim 5 wherein the detectable signal is unique to a particular combination of graphic representations displayed on the first and second sides.

8. Apparatus for playing a game comprising:

a plurality of disk-shaped playing pieces, each playing piece comprising:

a first face bearing a first graphic representation;

a second face bearing a second graphic representation distinguishable from the first graphic representation; and an edge disposed between the first face and the second face and including a first outwardly angled wall and a second outwardly angled wall that form an apex;

wherein the playing piece is adapted to land in one of three orientations when tossed onto a surface: on the first face so as to display the second graphic representation, on the second face so as to display the first graphic representation, or on a portion of the edge;

a deformable playing surface including a plurality of placeholders and configured to store the plurality of playing pieces; and a plurality of markers adapted to be placed on the placeholders.

9. The apparatus of claim 8 further comprising rules for the game specifying one or more designated hands, wherein each designated hand is a specific combination of the first and second graphic representations displayed by two or more of the playing pieces after the playing pieces are tossed by a player.

10. The apparatus of claim 9 wherein each designated hand is associated with an action that may be taken by the player.

11. The apparatus of claim 9 wherein at least one of the designated hands enables a player to place a marker on one of the placeholders.

12. The apparatus of claim 9 wherein at least one of the designated hands enables a player to remove an opponent's marker from one of the placeholders.

13. The apparatus of claim 9 further comprising a plurality of playing elements, each of the playing elements denoting at least one designated hand and an action that may be taken by a player holding both the playing element and the designated hand.

14. The apparatus of claim 13 wherein the playing elements take the form of cards.

15. The apparatus of claim 9 wherein the plurality of playing pieces are divisible into two or more distinguishable subsets.

16. The apparatus of claim 15 wherein the subsets are distinguishable by the color of the playing pieces.

17. The apparatus of claim 8 wherein each of the playing pieces further includes a detectable element adapted to produce a detectable signal.

18. The apparatus of claim 17 wherein the detectable element includes one or more resistors.

19. The apparatus of claim 17 wherein the detectable signal is unique to a particular combination of graphic representations displayed on the first and second sides.

20. A method of playing a game including rules for playing the game, a playing surface having a plurality of placeholders, a plurality of markers adapted to be placed on the placeholders, and a plurality of disk-shaped playing pieces, each playing piece having a first face bearing a first graphic representation, a second face bearing a second graphic representation distinguishable from the first graphic representation, and an edge disposed between the first face and the second face and including a first outwardly angled wall and a second outwardly angled wall that form an apex, wherein the playing piece is capable of landing in one of three orientations when tossed onto a surface: on the first face so as to display the second graphic representation, on the second face so as to display the first graphic representation, or on a portion of the edge, the method comprising:

acquiring a set of playing pieces;

obtaining a hand by:

tossing a set of the playing pieces so that each piece lands in one of the three possible orientations;

tipping any piece that lands on a portion of its edge to either side to obtain a desired hand;

selecting a subset of the pieces in the set to toss a second time to achieve a more desirable hand;

tossing the selected subset; and tipping any piece that lands on a portion of its edge to either side, as desired;

comparing the hand with an opponent's hand to determine a turn winner; and rewarding the turn winner.

21. The method of claim 20 wherein the steps for obtaining a hand are performed by two or more players simultaneously.

22. The method of claim 20 wherein the steps for obtaining a hand are performed by two or more players in turn.

23. The method of claim 20 wherein the desired hand is selected from a predetermined subset of all possible hands.

24. The method of claim 23 wherein at least one of the hands in the predetermined subset is described in the rules and available to all players.

25. The method of claim 23 wherein at least one of the hands in the predetermined subset is described on a game element and is available only to a player having the game element in play.

26. A generally disk-shaped playing piece for a game comprising:

a shell portion having a disk shape with two faces and an edge, the shell portion including a first half and a second half forming a hollow core section therebetween, the first and second halves each having an outer wall that forms a portion of the edge, wherein the outer walls form an apex along the edge; and a weight configured to fit within the hollow core section of the shell.

27. The playing piece of claim 26, wherein the outer wall of the first half is narrower than the outer wall of the second half.

28. The playing piece of claim 26, wherein the weight is disk shaped.

29. The playing piece of claim 28, wherein the weight is annular shaped.

30. The playing piece of claim 26, further comprising a circuit board configured to fit within the hollow core.

31. The playing piece of claim 30, wherein the shell includes a plurality of holes aligned with a plurality of contacts on the circuit board.

32. The playing piece of claim 30, wherein the circuit board is disk shaped.

* * * * *